US005335772A

United States Patent [19]

Chervenak et al.

[11] Patent Number: 5,335,772

[45] Date of Patent: Aug. 9, 1994

[54] TOOL DISPLAY PACKAGE

[75] Inventors: Thomas M. Chervenak, Beatrice; Jeffrey Spanski, Lincoln; Steven Zlomke, Beatrice, all of Nebr.

[73] Assignee: Petersen Manufacturing Co., Inc., DeWitt, Nebr.

[21] Appl. No.: 997,456

[22] Filed: Dec. 28, 1992

[51] Int. Cl.[5] ..... A45C 11/26

[52] U.S. Cl. ..... 206/349; 206/461; 206/493; 206/495

[58] Field of Search ..... 206/349, 477, 493, 495, 206/461, 467

[56] References Cited

U.S. PATENT DOCUMENTS

| | | | |
|---|---|---|---|
| 3,674,138 | 7/1972 | Gilmour | 206/493 |
| 3,927,765 | 12/1975 | Beal | 206/495 |
| 3,963,123 | 6/1976 | Beal | 206/495 |
| 4,634,005 | 1/1987 | Kulzer et al. | 206/477 |
| 4,872,551 | 10/1989 | Theros | 206/349 |

FOREIGN PATENT DOCUMENTS

| | | | |
|---|---|---|---|
| 2435932 | 5/1980 | France | 206/349 |
| 2243592 | 11/1991 | United Kingdom | 206/349 |

*Primary Examiner*—David T. Fidei

*Attorney, Agent, or Firm*—Willian Brinks Hofer Gilson & Lione

[57] ABSTRACT

A display package, enabling a user to manipulate a tool having a pair of tool openings that is positioned within the display package. The display package has a base and a plate having a plate opening having an edge. A first support element extends from the base to the plate where the first support element expansively engages the edge of the plate opening. A second support element is also present that extends from the base to the plate, where the first support element has a portion of a size to be inserted through the first tool opening and the second support element has a portion of a size to be inserted through the second tool opening.

45 Claims, 7 Drawing Sheets

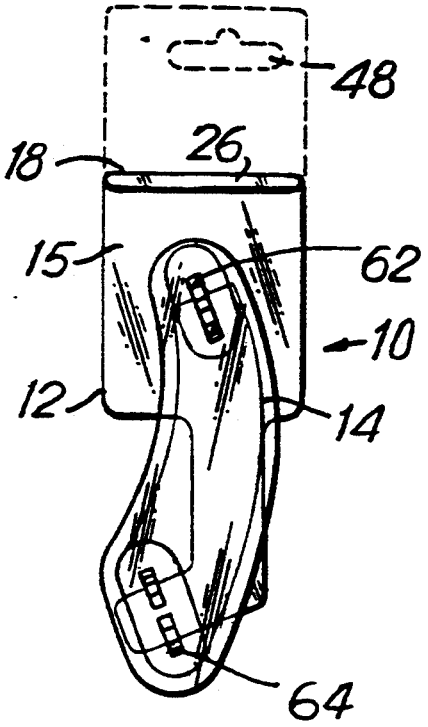
FIG. 2
FIG. 3
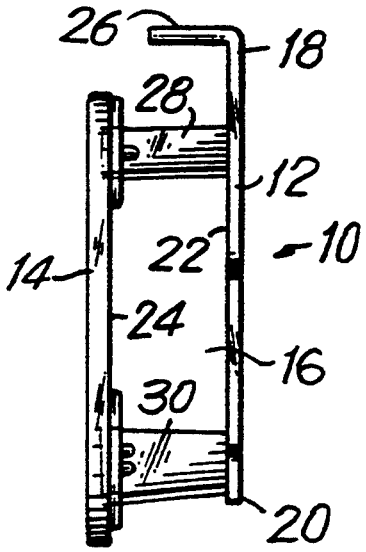
FIG. 4
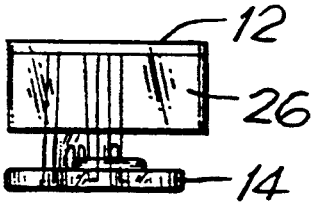

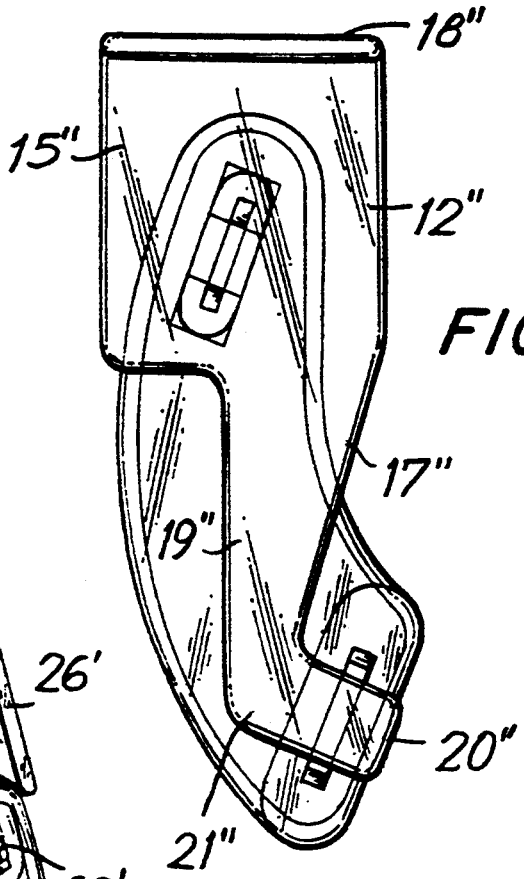
FIG. 8
FIG. 9
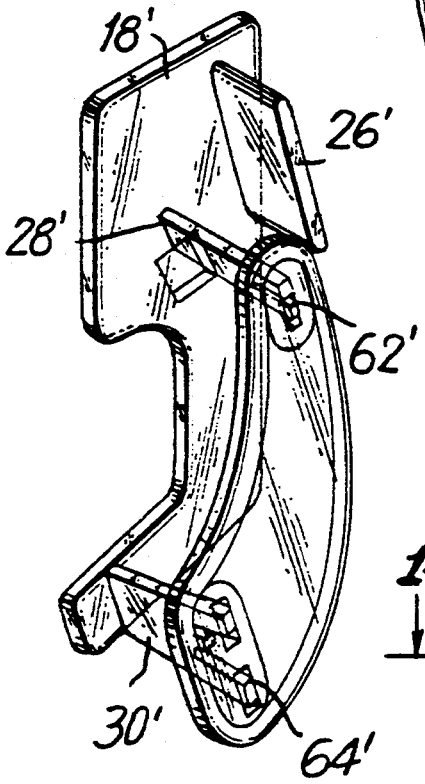
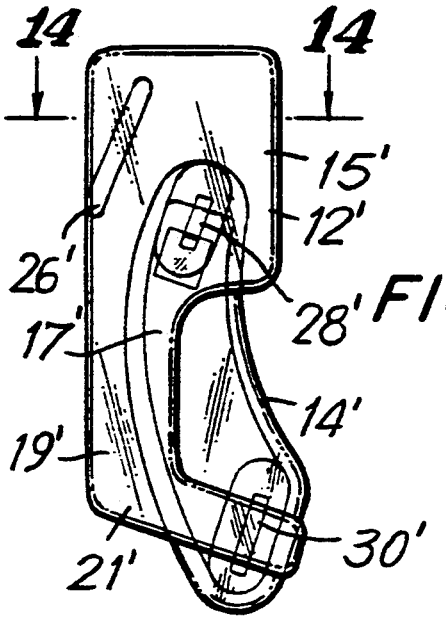
FIG. 10

TOOL DISPLAY PACKAGE

FIELD OF THE INVENTION

The present invention relates to display packages and more specifically relates to such a package used to display tools such as locking pliers in a manner which permits working manipulation of the hand tool by a prospective purchaser at a point of sale.

BACKGROUND OF THE INVENTION

Display packages have been known for some time, and it quite customary to produce hand tools or other products enclosed within a package made of transparent, stiff, flexible material such as polyvinylchloride (PVC) and secured to a card by heat and/or adhesive. Other types of display packages are also known. The known display packages typically enclose the article of merchandise; and it is normally quite difficult for a purchaser to touch or test the packaged tool without destroying a blister or other type of package or removing the tool from the package.

Purchasers of tools, in general, and locking pliers specifically, particularly professional tradesmen and craftsmen, look for product characteristics, such as size and finish of the handles, the ability to lock the tool in certain positions. They also often want to feel the operation of the tool, and to adjust the gap between the jaws. The ability to manipulate hand tool parts prior to purchase is a feature welcomed by customers and, therefore, a definite sales incentive to the manufacturer.

Display packages for tools are known in which some working portions of the tools are accessible through the package. However, a drawback of conventional blister-and-card and clam shell type tool packages is that existing packages of this type do not allow locking pliers or similar tools to be displayed and still function so that elements of the tool can be manipulated. Yet another drawback of conventional blister-and-card packages is that the tool is not substantially visible through the package.

Thus, there is a need for a display package for tools which may be easily and inexpensively produced. There is also a need for the display packages for locking pliers to permit substantial product visibility, plus the ability to manipulate, as well as to provide access to handles, jaws, and other parts of the tool prior to purchase. Furthermore, there is a need for a package for locking pliers which, in addition to the above-described characteristics, may be easily hung on store displays.

BRIEF DESCRIPTION OF THE DRAWINGS

Other advantages and features of the invention are described with reference to exemplary embodiments, which are intended to explain and not to limit the invention, and are illustrated in the drawings in which:

FIG. 2 is a front view of a container used with the display package;

FIG. 3 is a right side view thereof;

FIG. 4 is a top view thereof;

FIG. 8 is a rear view of an alternate container of the package;

FIG. 9 is a perspective view of an alternate container of the package;

FIG. 10 is a rear view thereof;

DESCRIPTION OF THE PREFERRED EMBODIMENTS

Although specific embodiments of the invention will now be described with reference to the drawings, it should be understood that the embodiments shown are by way of example only and merely illustrative of but a few of many possible specific embodiments which can represent applications of the principles of the invention. Changes and modifications, obvious to one skilled in the art to which the invention pertains are deemed to be within the spirit, scope, and contemplation of the invention as further defined in the appended claims.

Figure 1:
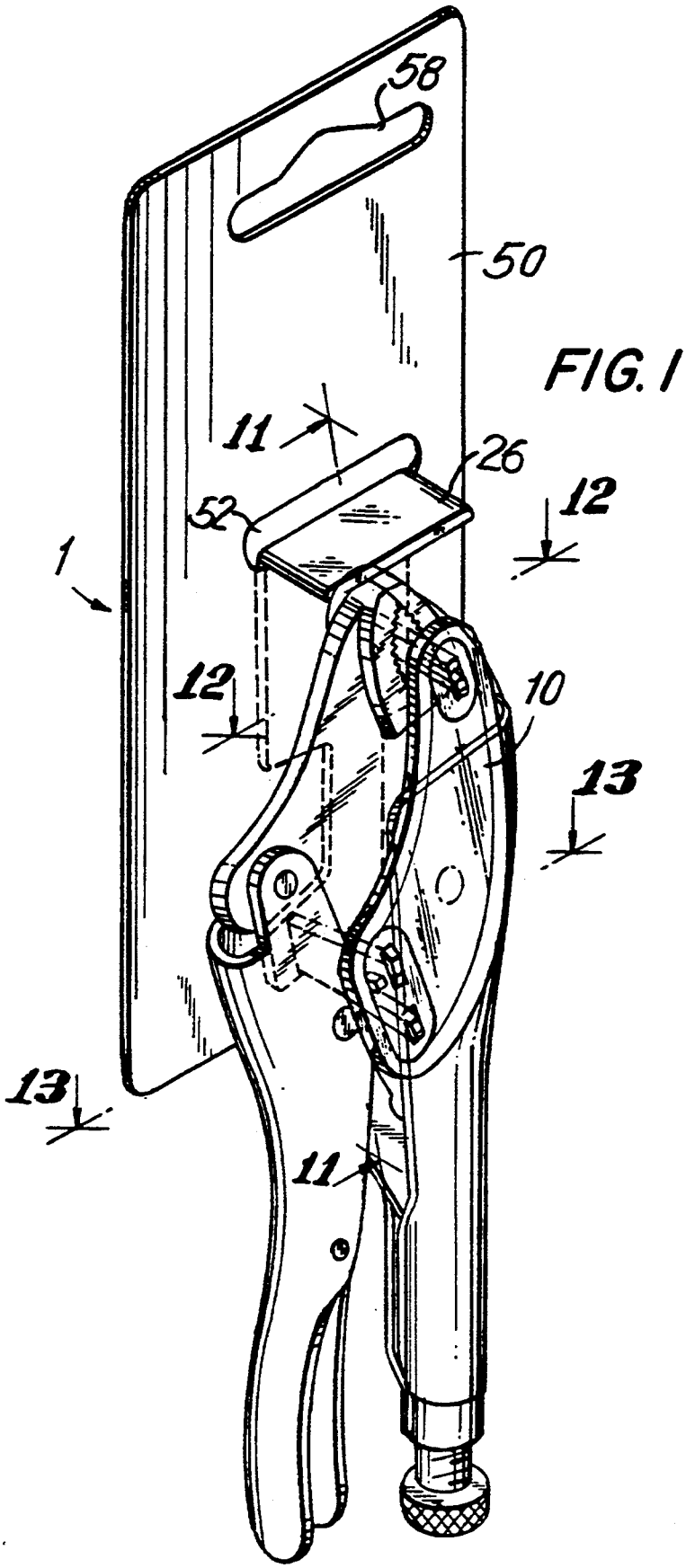
FIG. 1 is a perspective view taken from the top and left side of our tool display package.

As best shown in FIG. 1, a tool package, generally designated by the reference numeral 1, includes a container 10 and a display card 50. It is illustrated in FIGS. 2–14 that the container typically consists of a base 12 and a plate 14 which are separated from each other by a space 16. The base 12 is usually formed as a substantially flat member having a front end 18 and a rear end 20. A first support member 28 and a second support member 30 connect the base to the plate 14 and extend between an upper surface 22 of the base and a lower surface 24 of the plate. The plate is provided with openings 62 and 64 adapted to receive free ends of the support elements. The opening 62 has a stop 35 and the opening 64 includes the stop 37 (See FIG. 11). A front wall or stop member 26 is positioned at the front end 18 remotely from the plate 14. In the embodiment of at least FIGS. 1–7 the front wall 26 is a substantially flat element which is transverse to a longitudinal axis of the base, and to a longitudinal axis of the container and extends along the front end 18. However, any suitable configuration of the front wall is within the scope of the present invention.

Figure 14:
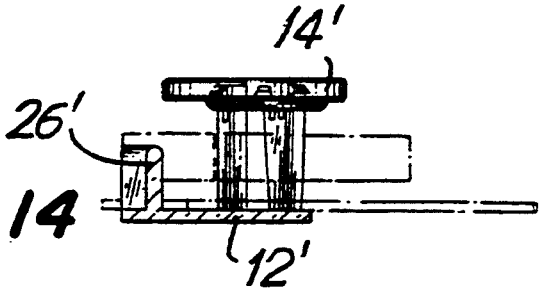
FIG. 14 is a cross sectional view taken along the section line 14—14 of FIG. 10.

For example, FIGS. 9, 10 and 14 best show another embodiment of the invention in which the front wall or stop member 26' extends at an angle to the front end 18' and can be substantially parallel to the first, substantially flat support element 28'. This arrangement is designed to accommodate locking pliers having relatively thin elongated jaws also known as long-nose pliers (see FIG. 16). The container of FIGS. 9, 10 and 14 is formed with an unrestricted area 27 in the vicinity of front end 18', so that the long jaws of the locking pliers guided by the first support member 28' and the front wall 26' can extend beyond the front end of the base, but are limited in the amount of forward movement by the front wall 26'.

The second support element 30 is located in the vicinity of the rear end 20 of the base, whereas the first support element 28 extends from an area of the base near the front end 18 and is positioned between the front wall 26 and the second support element.

Figure 5:
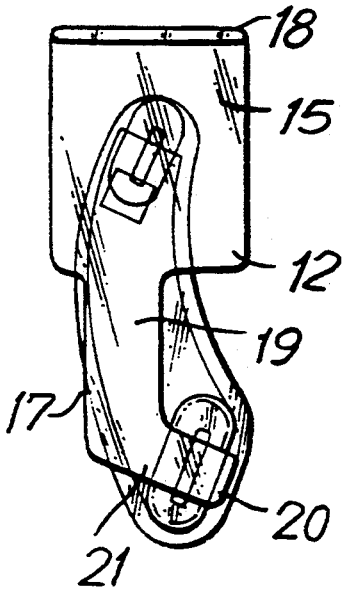
FIG. 5 is a rear view thereof.
Figure 6:
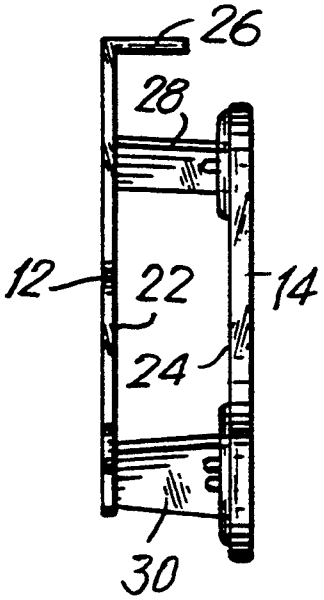
FIG. 6 is a left side view thereof.
Figure 7:
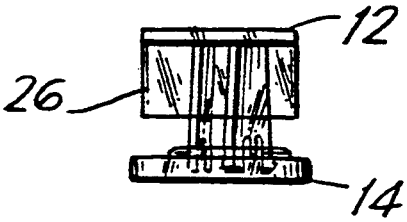
FIG. 7 is a bottom plan view of the container.

In the embodiment of the present invention illustrated in FIGS. 2–7, the base 12 consists of a main rectangular shaped portion 15 extending from the front end 18 toward a central part of the container, and a leg portion 17 connecting the main part with the rear end 20. The leg portion includes a connecting part 19 and receiving part 21 positioned at an angle to each other. The receiving part is typically adapted to accept one end of the second support element 30. Since the width of the connecting part 19 is substantially smaller than the width of the main portion 15, two shoulders are developed at a Junction of these elements. It is shown in FIG. 5 that an outside contour of the connecting part 19 is formed by two substantially parallel sides. An outside contour of the receiving part 21 is also partially formed by two straight lined parallel sides.

In the embodiment of FIG. 8 showing an alternate design of the container, the base 12″ consists of the main part 15″ and a leg 17″ having connecting part 19″ and receiving part 21″. The configuration of the receiving part 21″ is somewhat similar to that of the receiving part 21 shown in FIG. 5. However, the connecting part 19″ is formed by two sides positioned at an angle to each other. There is only one shoulder formed at the junction between the connecting part 19″ and the main part 15″.

In the embodiment of FIGS. 9, 10 and 14 the configuration of the leg 17′ is somewhat similar to the configuration of the leg 17. However, one side of the connecting part is a continuation of one side forming the main part 15′. Only one shoulder is provided at the junction between the main part and the connecting part of the leg.

Figure 15:
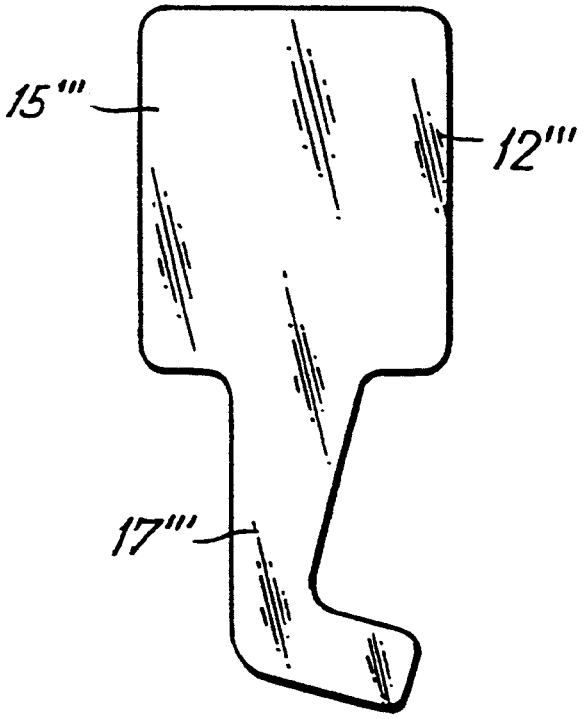
FIG. 15 is a rear view of an alternate base of the container.

Another design of the base 12‴ having the main part 15‴ and the leg 17‴ is shown in FIG. 15.

A person of ordinary skill in the present art will appreciate that the present invention is not limited to the above-described embodiments of the base and any suitable design of the base forms a part of this invention.

Figure 11:
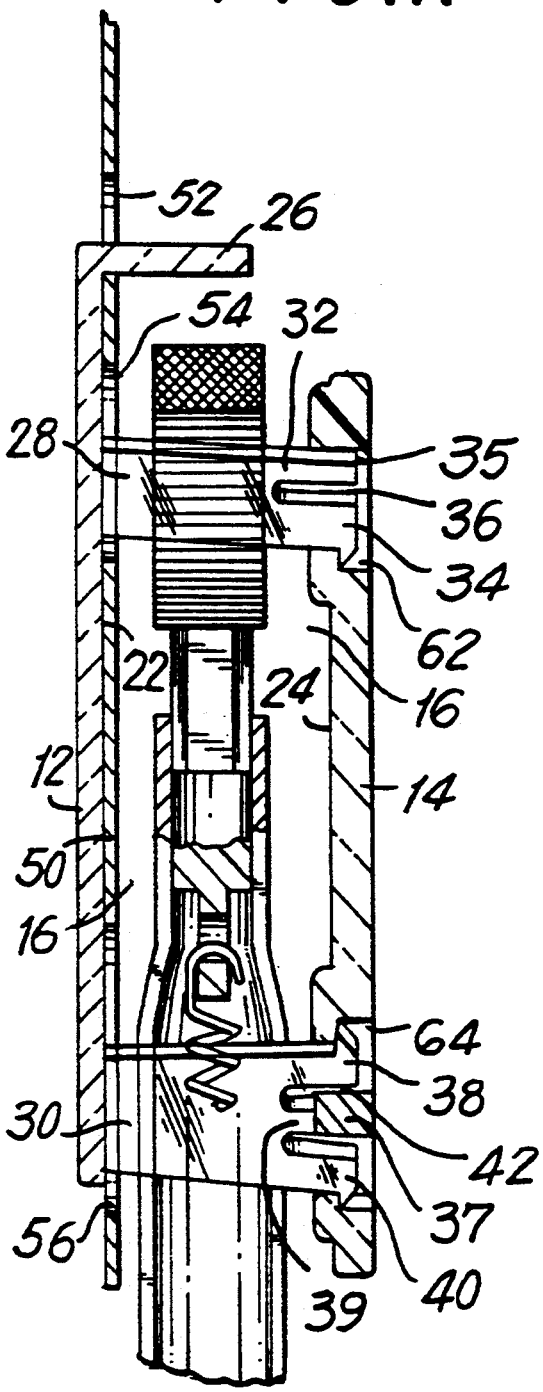
FIG. 11 is a cross sectional view taken along the section line 11—11 of FIG. 1.
Figure 12:
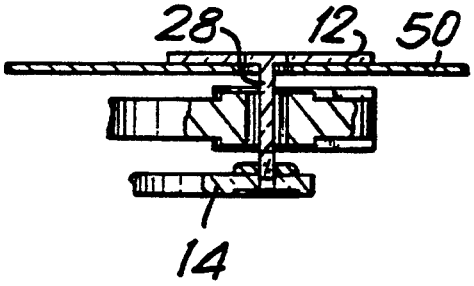
FIG. 12 is a cross sectional view taken along the section line 12—12 of FIG. 1.
Figure 13:
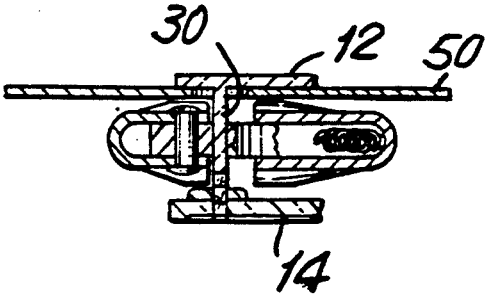
FIG. 13 is a cross sectional view taken along the section line 13—13 of FIG. 1.

The first and second support elements of the preferred embodiment are best shown in FIG. 11. Typically, one end of the first and second support elements 28 and 30, respectively, is fixedly attached to the upper surface 22 of the base. The other end of each support element remote from the Upper surface is designed to removably engage the plate 14. The first support member 28 includes two substantially vertical arms 32 and 34 separated by a space 36. The upper part of at least the arm 34 is adapted for removable engagement with an opening 62 of the plate 14. The first support member is typically manufactured from a relatively thin and flexible plastic material so that the resiliency of the arm 34 simplifies insertion and removal of the arm into and from the opening in the plate. The stop 35 of the opening 62 enables the invention in the assembled condition thereof to maintain the space 16 between the base 12 and the plate 14 upon engaging the arm 32 of the first support element.

The other end of the second support member 30 is formed with two arms 38 and 40 positioned at an angle to each other and each having a free end. The arms are separated by a space 42. It is shown in FIG. 11 that in the assembled condition of the invention, the stop 37 of the opening 64 engages a member 39 provided within the space 42. Such engagement prevents the plate 14 from further movement toward the base and maintains the space 16.

The second support element is also made from a flexible plastic material which produces spring action of the arms and enhances positioning of the free ends of the arms within an opening 64 of the plate.

Although reusable connection means between the support elements and the plate, such as the above-discussed arms, have been discussed hereinabove, it should be understood that any conventional type of removable engagement between the support elements and the plate is within the scope of the invention.

In use, the plate is initially removed from the container and the display card is positioned on the upper surface 22 of the base. Then, the tool is positioned within the package. The height of the first and second support elements is such that when the tool is situated within the container and the openings of the plate engage the arms of the support elements, there is a small gap between the tool, the upper surface 22 of the base and/or the lower surface 24 of the plate to enhance manipulation of the tool. The above discussed removable feature makes the present invention more versatile since the package can be used not only for the display purposes in a store, but also can be utilized as a storage container by craftsmen. It should be appreciated that the package in which the plate is permanently attached to the support elements is deemed to be within the spirit of the invention.

As illustrated in FIG. 2 in dotted lines, the base 12 of the container can be extended beyond the front end 18 and an aperture 48 can be disposed about the distal end of this extension. Consequently, the display package carrying a tool may be suspended from hooks of a display rack (not shown) in a store. The aperture can be centrally located. However, where the center of gravity of the package is asymmetrical, the positioning of the aperture 48 may be off center. In this embodiment of the invention the container is used without the display card and advertising materials can be positioned on either side of the extended part of the base.

In the preferred embodiment of the invention, the container 10 is typically used in combination with a display card 50 best illustrated in FIGS. 1 and 11. The display card is formed with holes 52, 54, and 56 which are adapted for engagement correspondently with the front wall 26, the first support element 28 and the second element 30 of the container. An aperture 58 is provided so that the card 50 engaging the container 10 carrying a tool can be suspended from a display rack. A longitudinal axis of the aperture 58 does not correspond to the longitudinal axis of the card 50. However, a modified card wherein these longitudinal axes coincide is also contemplated. The card 50 is shown in FIG. 1 having a substantially rectangular configuration. Nevertheless, any suitable shape of the display card carrying advertising materials on both surfaces thereof is within the scope of this invention.

Figure 16:
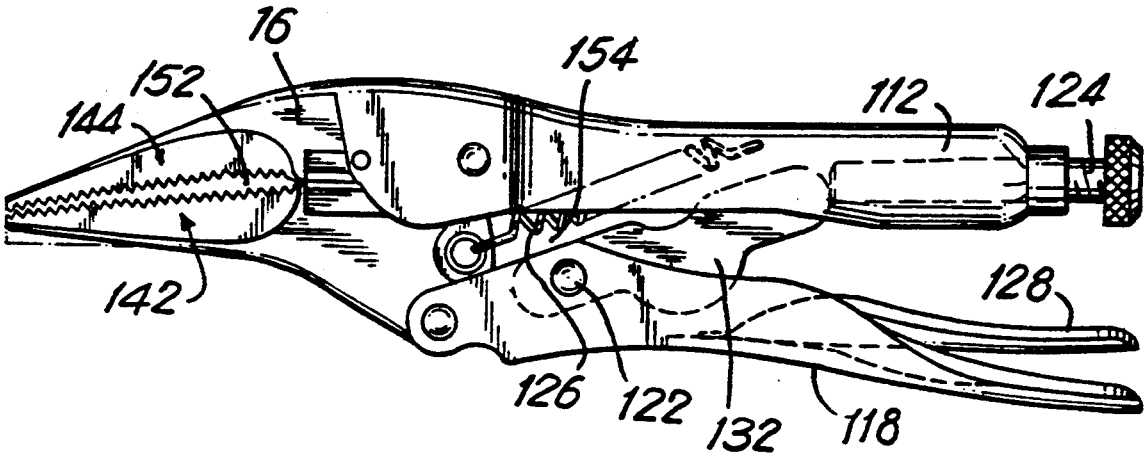
FIG. 16 is a front view of a tool used in combination with the package.
Figure 17:
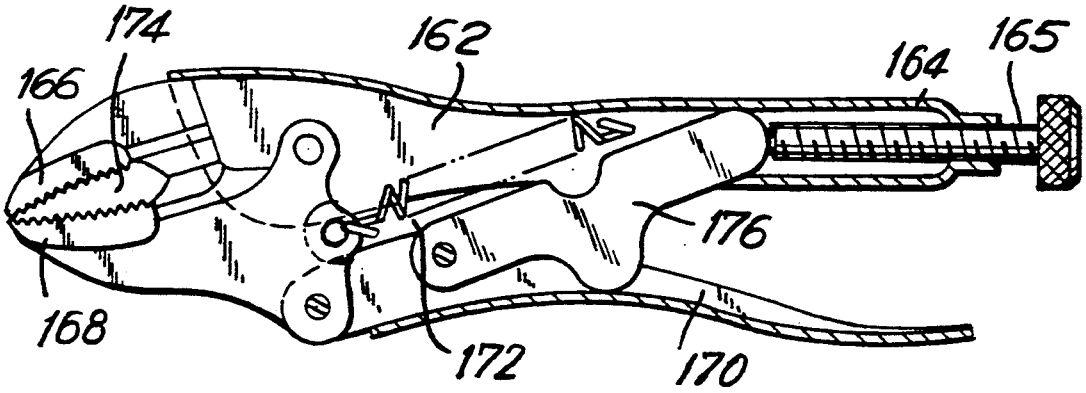
FIG. 17 is a front view of another tool used in combination with the package.

The display package of the invention is typically used in combination with hand tools or locking pliers shown in FIGS. 16 and 17. Locking pliers illustrated in FIG. 16 include a handle member 118, and a movable clamping member or lower jaw 142. A handle member 112 is provided with a stationary clamping element or upper jaw 144. The upper and lower Jaws shown in FIG. 16 are of the long-nose type having an elongated relatively thin configuration. An opening 152 is formed at an area of engagement between these jaws. A toggle mechanism comprising a toggle-link member 132 is conventionally pivotally engaged at one end about a pin 122. The other free end (shown in phantom) of the toggle link member 132 is engaged with the handle member 112. Spring means 126, preferably in the form of an extension coil spring, is secured between the handle member 112 and the movable clamping element 142 or lower jaw, to urge the clamping element 142 away from the stationary clamping element when the jaws are opened. FIG. 16 shows a space 154 separating the handles.

An elongated release lever 128 is pivotally mounted to the inside of the handle member, and is provided with a forwardly extending portion (as shown in phantom), and is engagable with a projection of the toggle-like member which extends toward the handle member 118.

The long-nose locking pliers of FIG. 16 are typically displayed and/or stored within the container illustrated in FIGS. 9, 10 and 14. This tool is positioned within the container in such a manner that the first support element 28' is situated with the opening 152 formed between the jaws 144 and 142, whereas the second support element 30' is received with the space 154 separating the handles. The upper jaw 144 extends between the stop member 26' and the first support element 28'. In view of the open space 27' at the front end 18', the jaws 144 and 142 can extend along the main part 15' of the base and beyond the front end 18'.

Another modification of the locking pliers is best illustrated in FIG. 17 and includes a fixed arm 162 having a fixed handle 164 at one end and a fixed Jaw 166 at the other end. A movable jaw 168 is pivotally attached to a movable handle member 170. A semi-open space 172 is shown between the fixed and movable handle. The jaws 166 and 168 are curved and bulky. An opening 174 is formed between engagement surfaces of the Jaws. A toggle-link member 176 is pivotally engaged with the movable handle. The other free end of the toggle-link engages a contacting part of a screw member 165.

The container 10 illustrated in FIGS. 1–7 as well as the container of FIG. 8 is adapted to accommodate the relatively short and curved jaws 166 and 168 of the pliers illustrated in FIG. 17. Longitudinal movement of this tool within the container is limited by the front wall 26, the first support element 28 inserted into the opening 174 between the jaws, and the second support element 30 situated in the open space 172 between the handles.

It will be appreciated that the wrench or locking pliers used in combination with the display package, with some exceptions, conform basically in accordance with the construction described in U.S. Pat. Nos. 1,489,458 and 3,192,804 which the present application incorporates by reference. As explained in these prior art patents, the movement of closing a locking wrench or pliers incorporating a toggle device toward the relatively fixed handle member forces the upper end of the toggle-like member to move inwardly towards the handle member. The pivot pin also moves inwardly, and when such pivot pin moves over center, the pliers are locked in a closed position.

Although the application of the novel package has been described with reference to locking pliers or similar tools, one should understand that this invention can be used with any tool having an opening adapted to receive the first support element and two handles separated by a space which accepts the second support element of the container.

The elements of the container 10 are typically formed by conventional thermoforming or molding and plastic fabrication techniques. Initially, during the assembly procedure, the plate 14 is removed from the base 12 and the display card is positioned in such a manner that the holes 52, 54, and 56 of the card engage the corresponding elements 26, 28, and 30 of the container. The distal end of the card bearing the aperture 58 extends substantially beyond the front end 18 of the base. Then, the hand tool is positioned within the package so that the first support element 28 is inserted within the opening between the jaws and the second support element is positioned in the open area between the handles. The front wall or stop member 26 is positioned in front of the jaws with the second support element 30 being situated between the handles. This results in substantial restrictions on the longitudinal movement of the tool within the package. Engagement between the first support element and interior parts of the jaws restrict such movement even further. This feature provides an important advantage to the invention because it protects the container by limiting the longitudinal movement of the tool, while it provides all necessary degrees of freedom for manipulation of the handles, adjustment screw, Jaws, etc. by a potential buyer. To complete the assembly process, the plate 14 is secured to the first and second support elements.

To improve visibility of the tool, all elements of the container 10 in general and the plate 14 specifically can be made of a transparent plastic. Thus, the invention provides an attractive display package for a locking pliers which permits manipulation of the handles, jaws, and the screw member by prospective customers at the point of purchase. Manipulation of these working components of the tool may be accomplished with or without removal of the tool from a display rack, or opening of the package. Furthermore, the package permits substantial visibility of the tool and may be displayed by being hung from a display rack or a pegboard display.

What is claimed is:

1. A tool display package, enabling a user to manipulate a tool having a first tool opening and a second tool opening, said tool being positioned within said display package, comprising:

a base;

a plate having a plate opening having an edge;

a first support element extending from said base to said plate, said first support element expansively engaging said edge of said plate opening;

a second support element extending from said base to said plate; and wherein said first support element having a portion thereof having a size sufficient to be inserted through said first tool opening and said second support element having a portion thereof having a size sufficient to be inserted through said second tool opening.

2. The tool display package of claim 1, comprising a wall extending at an angle with respect to said base.

3. The tool display package of claim 2, wherein said wall is attached to said base.

4. The tool display package of claim 3, wherein said angle is approximately 90°.

5. The tool display package of claim 1, wherein said first support element has a free end that expansively engages said edge of said plate opening.

6. The tool display package of claim 5, wherein said free end comprises a first arm and a second arm separated from each other by a distance that is greater than the size of said plate opening.

7. The tool display package of claim 6, wherein said plate opening comprises a recess for receiving an end of said first arm.

8. The tool display package of claim 1, wherein said portion of said first support element is substantially parallel with respect to said portion of said second support element.

9. The tool display package of claim 1, comprising a panel having a first insertion opening and a second insertion opening for receiving said first support element and said second support element, respectively.

10. The tool display package of claim 9, wherein said panel is positioned between said plate and said base.

11. The tool display package f claim 2, wherein said panel comprises a hole to receive said wall.

12. The tool display package of claim 11, wherein said panel is positioned between said plate and said base.

13. The tool display package of claim 1, wherein said plate is transparent.

14. The tool display package of claim 1, wherein sad base is transparent.

15. A tool display package system, enabling a user to manipulate a tool being positioned within said display package having a first tool opening and a second tool opening, said tool being positioned within said display package, said system comprising:

a base;

a plate having a plate opening having an edge;

a first support element extending form said base to said plate, sad first support element expansively engaging said edge of said plate opening;

a second support element extending from said base to said plate;

a tool having a first tool opening and a second tool opening, wherein said tool is operable while within said tool display package; and wherein said first support element has a portion inserted through said first tool opening and said second support element has a portion inserted through said second tool opening.

16. The tool display package system of claim 15, wherein said tool is fully operational and is unencumbered by said tool display package.

17. The tool display package system of claim 16, wherein said plate is transparent so that one can see the operation of said tool while positioned within said tool display package.

18. The tool display package system of claim 16, wherein said base is transparent so that one can see the operation of said tool while positioned within said tool display package.

19. The tool display package system of claim 15, wherein said tool is transitionally movable along a first direction.

20. The tool display package system of claim 19, wherein said second support element limits translational movement of said tool along a direction opposite to said first direction.

21. The tool display package system of claim 20, comprising a wall extending from said base so as to limit translational movement of said tool along said first direction.

22. The tool display package system of claim 1, wherein said wall extends approximately perpendicular with respect to said base.

23. The tool display package system of claim 21, wherein said wall is perpendicular to said first direction.

24. The tool display package system of claim 21, wherein said wall is angled by an angle substantially less than 90° with respect to said first direction.

25. The tool display package system of claim 15, wherein said first support element has a free end that expansively engages said edge of said plate opening.

26. The tool display package system of claim 25, wherein said free end comprises a first arm and a second arm separated from each other by a distance that is greater than the size of said plate opening.

27. The tool display package system of claim 26, wherein said plate opening comprises a recess for receiving an end of said first arm.

28. The tool display package system of claim 15, wherein said portion of said first support element is substantially parallel with respect to sad portion of said second support element.

29. The tool display package system of claim 25, comprising a panel having a first insertion opening and a second insertion opening for receiving said first support element and said second support element, respectively.

30. The tool display package system of claim 29, wherein said panel is positioned between said plate and said base.

31. The tool display package system of claim 29, wherein said panel comprises a hole to receive said wall.

32. The tool display package system of claim 31, wherein said panel is positioned between said plate and said base.

33. A tool display package system, enabling a user to manipulate a tool positioned within a tool display package, said system comprising:

a tool having a first opening and a second opening;

said tool positioned within a tool display package and operable while within said tool display package, said tool display package comprising:

1) a base;

2) a plate separated from said base so that a space for positioning said tool therein is defined between said base and said plate;

3) a first support element extending from said base to said plate within said defined space, said first support element being positioned within said first opening of said tool and limiting the amount of rotation of said tool about a pivot point;

4) a second support element extending from said base to said plate within said defined space, said second support element being positioned within said second opening of said tool, wherein said tool rests on said second support element and said second support element defines said pivot point; and wherein said tool is operable while being positioned within said tool display package.

34. The tool display package system of claim 33, wherein said tool is fully operational and is unencumbered by said tool display package.

35. The tool display package system of claim 34, wherein said plate is transparent so that one can see the operation of said tool while positioned within said tool display package.

36. The tool display package system of claim 34, wherein said base is transparent so that one can see the operation of said tool while positioned within said tool display package.

37. The tool display package system of claim 33, wherein said tool comprises a locking plier having a pair of jaws operated by two handles, wherein said second opening comprises a space defined between said pair of jaws.

38. The tool display package system of claim 37, wherein said locking plier is fully operational and is unencumbered by said tool display package.

39. The tool display package system of claim 37, wherein said two handles define said first opening.

40. The tool display package system of claim 33, wherein said tool is transitionally movable along a first direction.

41. The tool display package system of claim 40, wherein said second support element limits translational movement of said tool along a direction opposite to said first direction.

42. The tool display package system of claim 41, comprising a wall extending from said base so as to limit translational movement of said tool along said first direction.

43. The tool display package system of claim 42, wherein said wall extends approximately perpendicular with respect to said base.

44. The tool display package system of claim 42, wherein said wall is perpendicular to said first direction.

45. The tool display package system of claim 42, wherein said wall is angled by an angle substantially less than 90° with respect to said first direction.

* * * * *

UNITED STATES PATENT AND TRADEMARK OFFICE

CERTIFICATE OF CORRECTION

PATENT NO. : 5,335,772
DATED : August 9, 1994
INVENTOR(S) : Thomas M. Chervenak

It is certified that error appears in the above-indentified patent and that said Letters Patent is hereby corrected as shown below:

In claim 11, line 1, delete "f" and substitute --of--.

In claim 14, line 1, delete "sad" and substitute --said--.

In claim 15, line 8, delete "form" and substitute --from--.

In claim 15, line 9, delete "sad" and substitute --said--.

In claim 19, line 2, delete "transitionally" and substitute --translationally--.

In claim 40, line 2, delete "transitionally" and substitute --translationally--.

Signed and Sealed this

Third Day of October, 1995

*Attest:*

Bruce Lehman

BRUCE LEHMAN

*Attesting Officer*

*Commissioner of Patents and Trademarks*